US008061099B2

(12) United States Patent
Andrews

(10) Patent No.: US 8,061,099 B2
(45) Date of Patent: Nov. 22, 2011

(54) VERTICAL DEFLECTION EXTENSION END MEMBER

(75) Inventor: William John Andrews, Cambewarra (AU)

(73) Assignee: TSF Systems, LLC

( * ) Notice: Subject to any disclaimer, the term of this patent is extended or adjusted under 35 U.S.C. 154(b) by 48 days.

(21) Appl. No.: 12/468,553

(22) Filed: May 19, 2009

(65) Prior Publication Data

US 2010/0293888 A1 Nov. 25, 2010

(51) Int. Cl.
*E04B 2/30* (2006.01)

(52) U.S. Cl. ..... 52/483.1; 52/475.1; 52/481.1; 52/243.1

(58) Field of Classification Search ..... 52/475.1, 52/481.1, 483.1, 243.1
See application file for complete search history.

(56) References Cited

U.S. PATENT DOCUMENTS

| | | | |
|---|---|---|---|
| 227,196 | A | 5/1880 | Alexander |
| 1,711,445 | A | 4/1929 | Burrenick |
| 1,766,098 | A | 6/1930 | Booth |
| 1,789,280 | A | 1/1931 | Armstrong |
| 2,058,386 | A | 10/1936 | Parsons |
| 2,173,721 | A | 9/1939 | McGee |
| 2,225,574 | A | 12/1940 | Thomson |
| 2,333,289 | A | 11/1943 | Bohnsack |
| 2,371,921 | A | 3/1945 | Tucker |
| 2,515,841 | A | 7/1950 | Stuart |
| 2,796,158 | A | 6/1957 | Miles et al. |
| 2,843,725 | A | 7/1958 | Granberg |
| 2,966,708 | A | 1/1961 | Freeman, Jr. |
| 3,125,193 | A | 3/1964 | Brown et al. |
| 3,160,280 | A | 12/1964 | Burch |
| 3,165,815 | A | 1/1965 | Wogerbauer |
| 3,217,452 | A | 11/1965 | Steele |
| 3,234,697 | A | 2/1966 | Toti et al. |
| 3,312,032 | A | 4/1967 | Ames |
| 3,332,197 | A | 7/1967 | Hinkle |
| 3,397,495 | A | 8/1968 | Thompson et al. |
| 3,656,223 | A | 4/1972 | Maisenbacher |
| 3,665,837 | A | 5/1972 | Balfanz, Jr. |
| 3,685,863 | A | 8/1972 | Oetiker |
| 3,690,082 | A | 9/1972 | Byland |
| 3,719,980 | A | 3/1973 | Van Bussel |
| 3,743,332 | A | 7/1973 | Sonolet |
| 3,753,324 | A | 8/1973 | Puccio |
| 3,753,328 | A | 8/1973 | Papsco |
| 3,778,175 | A | 12/1973 | Zimmer |
| 3,831,333 | A | 8/1974 | Nelsson et al. |
| 3,834,212 | A | 9/1974 | Roper |

(Continued)

FOREIGN PATENT DOCUMENTS

| | | |
|---|---|---|
| AU | 30388 | 10/1972 |

(Continued)

*Primary Examiner* — William V Gilbert
*Assistant Examiner* — Gisele Ford
(74) *Attorney, Agent, or Firm* — Kit M. Stetina; Edward W. Callan

(57) ABSTRACT

A wall structure has a telescoping portion and a stationary portion. An overlapping section of the telescoping portion has a recess to allow dry wall to be fastened to the stationary portion at the overlapping section without being attached to the telescoping portion. The fastener pierces through the drywall and a sidewall of the stationary portion. However, a tip of the fastener does not engage a sidewall of the telescoping portion. Rather, the tip of the fastener stops within the recess of the telescoping portion.

20 Claims, 5 Drawing Sheets

U.S. PATENT DOCUMENTS 3,845,601 A 11/1974 Kostecky
3,861,101 A 1/1975 Whisson
3,861,103 A 1/1975 Rasmussen
3,872,633 A 3/1975 Altosaar et al.
3,925,948 A 12/1975 Sauer et al.
3,999,875 A 12/1976 Simon
4,018,020 A 4/1977 Sauer et al.
4,019,291 A 4/1977 Ernst
4,038,799 A 8/1977 Shanks
4,074,487 A 2/1978 Daniels et al.
4,272,930 A 6/1981 Foster
4,283,892 A * 8/1981 Brown ..... 52/213
4,329,820 A 5/1982 Wendt
4,361,994 A 12/1982 Carver
4,364,212 A 12/1982 Pearson et al.
4,397,127 A 8/1983 Mieyal
4,464,074 A 8/1984 Green et al.
4,709,517 A 12/1987 Mitchell et al.
4,713,921 A 12/1987 Minialoff et al.
4,734,971 A 4/1988 Dupasquier
4,757,657 A 7/1988 Mitchell et al.
4,760,682 A 8/1988 King
4,798,029 A 1/1989 Carlton
4,809,476 A 3/1989 Satchell
4,854,096 A 8/1989 Smolik
4,918,899 A 4/1990 Karytinos
5,040,345 A * 8/1991 Gilmour ..... 52/243.1
5,079,884 A 1/1992 Menchetti
5,081,813 A 1/1992 White
5,095,678 A 3/1992 Murphy
5,127,760 A 7/1992 Brady
5,129,204 A 7/1992 Palumbo
5,157,883 A 10/1992 Meyer
5,203,132 A 4/1993 Smolik
5,222,335 A 6/1993 Petrecca
5,285,615 A 2/1994 Gilmour
5,315,804 A 5/1994 Attalla
5,394,665 A 3/1995 Johnson
5,497,591 A 3/1996 Nelson
5,592,796 A 1/1997 Landers
5,596,859 A 1/1997 Horton et al.
5,600,991 A 2/1997 Munzen
5,649,688 A 7/1997 Baker
5,685,121 A 11/1997 DeFrancesco et al.
5,692,405 A 12/1997 Kirii
5,720,138 A 2/1998 Johnson
5,729,950 A 3/1998 Hardy
5,735,100 A 4/1998 Campbell
5,755,066 A 5/1998 Becker
5,797,233 A 8/1998 Hascall
5,819,578 A 10/1998 Codatto
5,930,968 A 8/1999 Pullam
5,950,385 A 9/1999 Herren
6,023,898 A 2/2000 Josey
6,029,334 A 2/2000 Hartley
6,032,504 A 3/2000 Onat et al.
6,098,435 A 8/2000 Takada
6,119,430 A * 9/2000 Nicholls ..... 52/846
6,199,341 B1 3/2001 Carlin et al.
6,374,558 B1 4/2002 Surowiecki
6,401,423 B1 6/2002 Bergeron et al.
6,418,682 B1 7/2002 Rice
6,453,627 B1 9/2002 Powers
6,557,254 B1 5/2003 Johnson
6,568,138 B1 5/2003 Frost et al.
6,609,285 B1 8/2003 Kinney
6,647,691 B2 11/2003 Becker et al.
6,758,022 B1 7/2004 Coll et al.
6,792,733 B2 9/2004 Wheeler et al.
6,871,470 B1 3/2005 Stover
6,964,079 B2 11/2005 Zimmer
6,983,569 B1 1/2006 Rosenberg
6,997,026 B2 2/2006 Fischer
7,086,265 B2 8/2006 Losch
7,127,862 B2 10/2006 Saldana
RE39,462 E 1/2007 Brady
7,216,465 B2 5/2007 Saldana
7,223,043 B1 5/2007 Andrews
7,594,331 B2 9/2009 Andrews et al.
2001/0017016 A1* 8/2001 Rudduck ..... 52/481.1
2003/0033770 A1 2/2003 Harel
2003/0089053 A1 5/2003 Elderson
2003/0145537 A1 8/2003 Bailey
2004/0035065 A1 2/2004 Orszulak et al.
2004/0055232 A1 3/2004 Jette
2004/0083665 A1 5/2004 Surowiecki
2004/0232290 A1 11/2004 Wilhelmsen et al.
2005/0034408 A1 2/2005 Palumbo et al.
2005/0079034 A1 4/2005 Maas
2005/0217344 A1 10/2005 Losch
2005/0229523 A1 10/2005 Bodnar
2006/0065345 A1 3/2006 James et al.
2006/0096192 A1 5/2006 Daudet
2006/0144009 A1 7/2006 Attalla
2006/0185315 A1 8/2006 Walker
2006/0191227 A1 8/2006 Orszulak et al.
2006/0277841 A1 12/2006 Majusiak
2006/0283130 A1* 12/2006 Andrews ..... 52/633
2007/0011971 A1 1/2007 Sitkiewicz
2007/0107369 A1* 5/2007 Andrews et al. ..... 52/741.1
2007/0175149 A1 8/2007 Bodnar
2007/0209306 A1* 9/2007 Andrews et al. ..... 52/317
2008/0110126 A1 5/2008 Howchin
2008/0159807 A1 7/2008 Andrews

FOREIGN PATENT DOCUMENTS

AU 21692 7/1978
AU 5482090 11/1990
AU 647605 4/1991
AU B1407092 10/1992
AU 642828 10/1993
AU B6057096 12/1996
AU 702437 2/1999
AU 4528100 12/2000
EP 0321183 6/1989
EP 0676513 10/1995
EP 0752745 6/1996
FR 2870760 12/2005
GB 2169937 7/1986
JP 52101819 8/1977
JP 9268701 10/1997
JP 2003293106 10/2003
JP 2004197804 7/2004
JP 2006062078 3/2006
LV 13363 12/2005
NZ 198360 9/1981
WO WO8810344 12/1988
WO WO9324712 12/1993
WO WO9508409 3/1995
WO WO9723694 7/1997
WO WO0014355 3/2000
WO WO0071827 11/2000

* cited by examiner

VERTICAL DEFLECTION EXTENSION END MEMBER

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates to wall structures that may be fire rated and/or accommodate seismic shifts or settlings of the building.

In building construction, conventional wall fabrication techniques employ wooden materials such as headers and footers as well as wooden vertical studs placed between the headers and footers to form a wall frame. Unfortunately, traditional wooden wall constructions suffer from several drawbacks including the excessive time to erect the wall structure, high material costs, and heavy weight.

In certain situations, metallic framing structures are now used in buildings due to its light weight, ease of erecting the wall structure and low expense. Nonetheless, these metallic wall frames suffer from other deficiencies. In particular, the metallic framing structures are fabricated similar to a wooden framing structure in that there are a plurality of vertical studs held between a header and footer. The header and footer are secured to the ceiling and floor to stabilize the wall structure. Unfortunately, during building fabrication, the distance between the ceiling and floor may vary. By way of example and not limitation, metallic framing structures may be implemented in high rise or mini rise structures. Each floor is comprised of a poured reinforced concrete. Variations between each floor (i.e., ceiling to floor distances) may be up to about six inches (6"). When the metallic framing structures are erected under these conditions, the metallic vertical studs must be cut to fit the ceiling to floor height or a plurality of different vertical stud lengths must be stored to fit the ceiling to floor height. Solutions have been presented to eliminate the need to cut to fit the vertical stud or store a variety of vertical stud lengths. One such solution is disclosed in U.S. Pat. No. 7,223,043 (hereinafter '043 Patent) issued to William Andrews. The '043 Patent discloses a metal stud member (i.e., vertical stud) and a metal plate member (i.e., header or footer) which interlock with each other via a simple twist and lock manipulation. Additionally, the vertical stud members may be telescopic in nature. The telescopic feature of the vertical studs accommodate the ceiling to floor variations that exist not only in high rise or mini rise structures but also in other types of structures. The installer attaches an upper metal plate member to the ceiling and a lower metal plate member to the floor in alignment with the upper metal plate member. The metal stud members are disposed between the upper and lower metal plate members and extended via the telescopic feature to the precise distance between the ceiling and floor (i.e., upper and lower metal plate members). The solution provided in the '043 Patent allows the installer to precisely fit the vertical stud member to the ceiling to floor height without cutting the metallic vertical stud member to length or storing various lengths of vertical stud members.

The metallic wall frame fabricated from the metallic header, metallic footer and metallic vertical stud members address the variations in ceiling to floor height during installation. However, other factors in future changes in the ceiling to floor height must also be considered. By way of example and not limitation, ceiling to floor height variations may occur during seismic shifts, fire due to thermal expansion, changes due to normal ambient temperature changes, and settling of the building during and after construction of the building. In most buildings, after the metallic wall frame is erected, drywall is attached to the metallic wall frame. To this end, a plurality of screws are screwed through the drywall and into the metallic vertical studs. Unfortunately, these screws may bind the inner and outer metallic vertical members that allow the metallic vertical stud to be telescopic. In essence, the screws lock the length or height of the vertical stud member. During seismic shifts, the ceiling to floor height may increase and decrease during the seismic shift. If the metallic vertical studs are no longer telescopic but fixed due to the screws, then these vertical studs may be crushed or pulled apart during the seismic shift. During fire, the building (i.e., floors, ceilings and wall structures) may experience heat that causes thermal expansion. The thermal expansion may cause the ceiling to floor height to increase or decrease. If the metallic vertical studs are not telescopic but fixed due to the screws, then in this situation also, the metallic vertical studs may be crushed or pulled apart due to the thermal expansion of the various parts of the building. Moreover, during construction and after completion, the building may settle into the ground thereby causing the ceiling to floor height to slowly change over a period of time. If the screws affixed to the metallic vertical studs do not allow the metallic vertical studs to be telescopic, then the settling of the building may cause the metallic vertical studs to rupture (i.e., pull apart) or be crushed under the weight of the building.

Solutions have been provided that address the changing nature of the ceiling to floor height distance. By way of example and not limitation, U.S. Pat. No. RE 39,462 (hereinafter '462 Patent) illustrates a vertically slotted header to allow for spatial variations in distance between a ceiling and floor. As shown in the '462 Patent, a header is attached to a vertical stud. The header is allowed to traverse vertically with respect to the vertical stud through a slot in a sidewall of the header. This type of vertical displacement is typically used for achieving a fire rating for the wall structure. In a fire, the distance between the ceiling and floor may change due to the thermal expansion of the wall structure. The allowable vertical displacement maintains the wall structure in tact despite different coefficients of thermal expansion of the various materials of the wall structure.

Unfortunately, the device of the '462 Patent suffers from various drawbacks. First, the amount of vertical displacement is limited by a length of the slot. Moreover, the lateral position of the stud with respect to the header is limited by the placement of the slot. The lateral position of the stud cannot be minutely adjusted based on the circumstances. The stud must be aligned to the slot. Additionally, the header shown in the '462 Patent is generally weak due to the plurality of unnecessary slots that are formed in the sidewalls of the header. If the header is subjected to a vertical load, then the header may be likely to deform at the location of the slots due to stress concentrations and the like. Moreover, the screw that attaches the sidewall of the header to the sidewall of the vertical stud is located at the very top of the wall frame and also close to the ceiling. As such, the construction worker has a very small area to work with in screwing the screw into the metallic header and vertical stud.

Another solution is disclosed in U.S. patent application Ser. No. 11/483,791 (hereinafter '791 Application), the entire contents of which is expressly incorporated herein by reference. In the '791 Application, the telescopic feature of the metallic vertical stud is retained despite the drywall being screwed into the vertical stud member. This is accomplished by slotting one of the telescoping members of the vertical stud member such that the screw attaching the drywall to the wall frame is secured only to one of the telescoping members and not both. Unfortunately, the length of the slot is not very long. It allows for only approximately a three inch (3") vertical deflection, a small amount. Additionally, since the drywall is placed over the plurality of vertical stud members, the location of the slot cannot be seen. As such, the installer may inadvertently screw the screw into both of the telescoping members that make up the telescopic vertical stud member. Accordingly, there is a need for a telescopic vertical stud member that allows for infinite vertical deflection and is not subject to installation error.

BRIEF SUMMARY

The wall structure discussed herein addresses the deficiencies discussed above, discussed below and those that are known in the art. The wall structure may comprise a metallic top track and a metallic bottom track and a plurality of metallic vertical studs disposed between the top track and the bottom track. Typically, these studs are spaced approximately 16" apart as is typical in wooden wall structures. The wall frame (i.e., header, footer, and studs) discussed herein is fabricated from metal (e.g., steel, etc.). Drywall may be attached to opposed sides of the top and bottom tracks and the plurality of vertical studs so as to form a wall structure. The drywall may be attached to the wall frame by screw fasteners. Additionally, the top and bottom tracks may respectively be attached to a ceiling and a floor of a building structure.

The wall structure discussed herein may have an infinite vertical range of movement because the vertical stud has a telescoping portion and a stationary portion which are nested within each other to permit infinite spatial variations between the top track attached to the ceiling and the bottom track attached to the floor without crushing or pulling apart the metallic vertical studs. The wall structure allows for ceiling to floor variations during (1) settling of the building, (2) seismic shifts and (3) expansions and contractions due to ambient temperature changes and fire. Additionally, the wall structure prevents detachment of the drywall from the wall frame (i.e., vertical studs, top and bottom tracks) due to the different thermal expansion rates of the drywall and the metallic wall frame when the wall is subjected to heat (e.g., fire).

To this end, the drywall is attached to only the stationary portion of the vertical stud and not to the telescoping portion and the top track. By way of example and not limitation, the stationary portion of the vertical stud may be attached to the bottom track. The stationary portion of the vertical stud may have a C-shaped configuration which circumscribes the telescoping portion. The telescoping portion may be pushed deeper into the stationary portion or pulled out of the stationary portion. In attaching the drywall to the stationary portion but not the telescoping portion, sidewalls of the telescoping portion which abut the sidewalls of the stationary portion may have an elongate recess. The elongate recess allows a fastener (e.g., screw) to be screwed into the drywall through the sidewall of the stationary portion to attach the drywall to the stationary portion. The length of the screw is sufficiently long to engage the threads of the screw to the drywall and the sidewall of the stationary portion but is short enough such that the threads of the screw do not engage the telescoping portion which would prevent vertical traversal of the telescoping portion within the stationary portion. Preferably, a tip of the screw does not contact a floor of the recess of the telescoping portion. In this manner, construction workers do not have to worry whether the screw that they are inserting to attach the drywall to the stationary portion is also engaging the telescoping portion. The reason is that the screws used to attach the drywall to the stationary portion is not long enough to engage the recessed sidewalls of the telescoping portion.

The configuration of the wall structure discussed herein permits the construction worker to quickly screw the drywall to the stationary portion without fear that the screw will engage both the stationary and telescoping portions. Also, the wall structure discussed herein accommodates thermal expansion due to fire or normal ambient temperature changes, seismic shifts and settling of the building.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
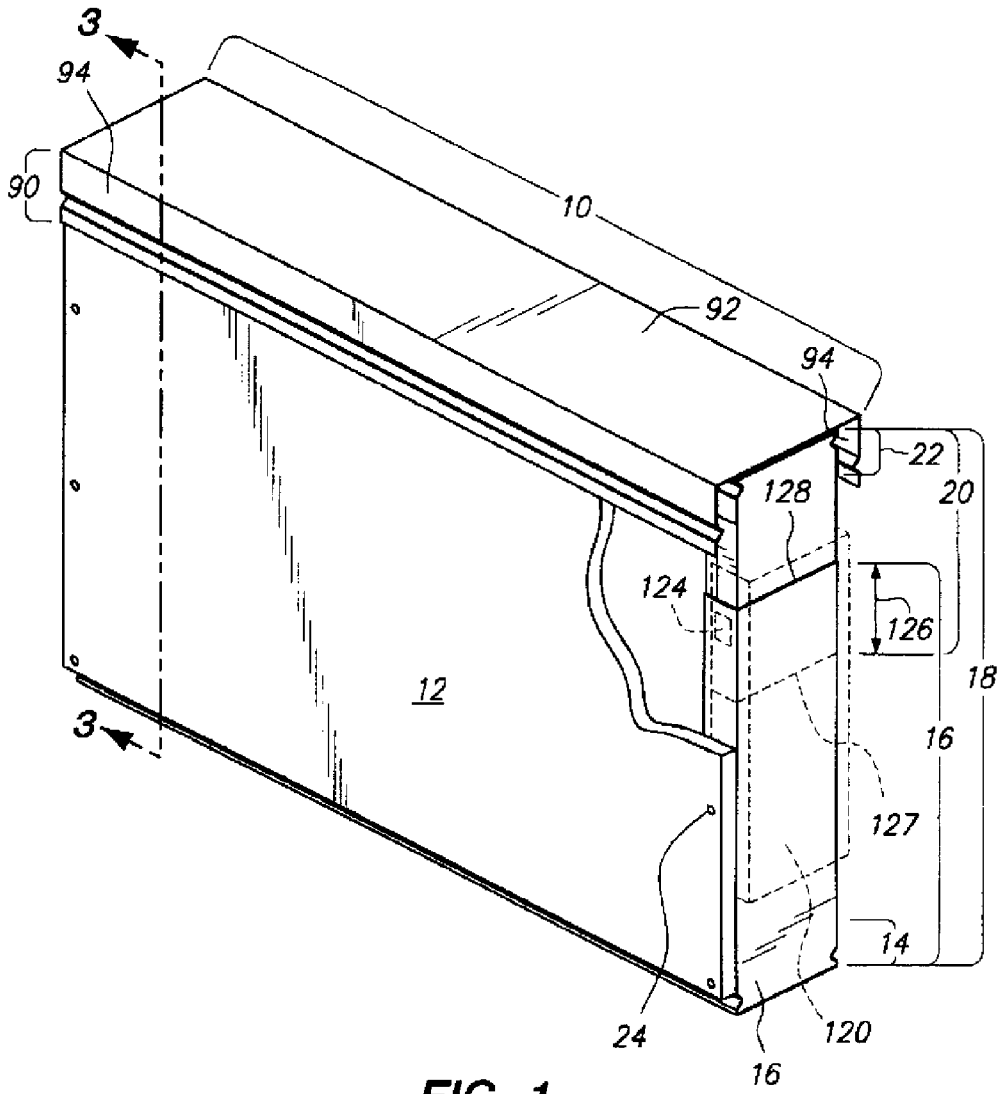
FIG. 1 is a perspective view of a wall structure that allows for ceiling to floor variations.

Referring now to FIG. 1, a wall structure 10 is shown. Drywall 12 is secured to stationary portions 16 of vertical studs 18 and not to telescoping portions 20 of the vertical studs 18. A top track 22 is attached to the telescoping portion 20 but not the drywall 12. When ceiling to floor variations occur such as during a fire, ambient temperature changes, settling of the building, earthquakes (i.e., seismic shifts, etc.), the telescoping portions 20 of the vertical studs 18 allow for variation in the ceiling to floor distance. Additionally, such construction would also mitigate detachment of the fasteners 24 from the drywall 12 due to different coefficients of thermal expansion of the drywall 12 and the material (e.g., steel) from which the vertical stud 18 is fabricated during ambient temperature changes or fire.

Figure 2:
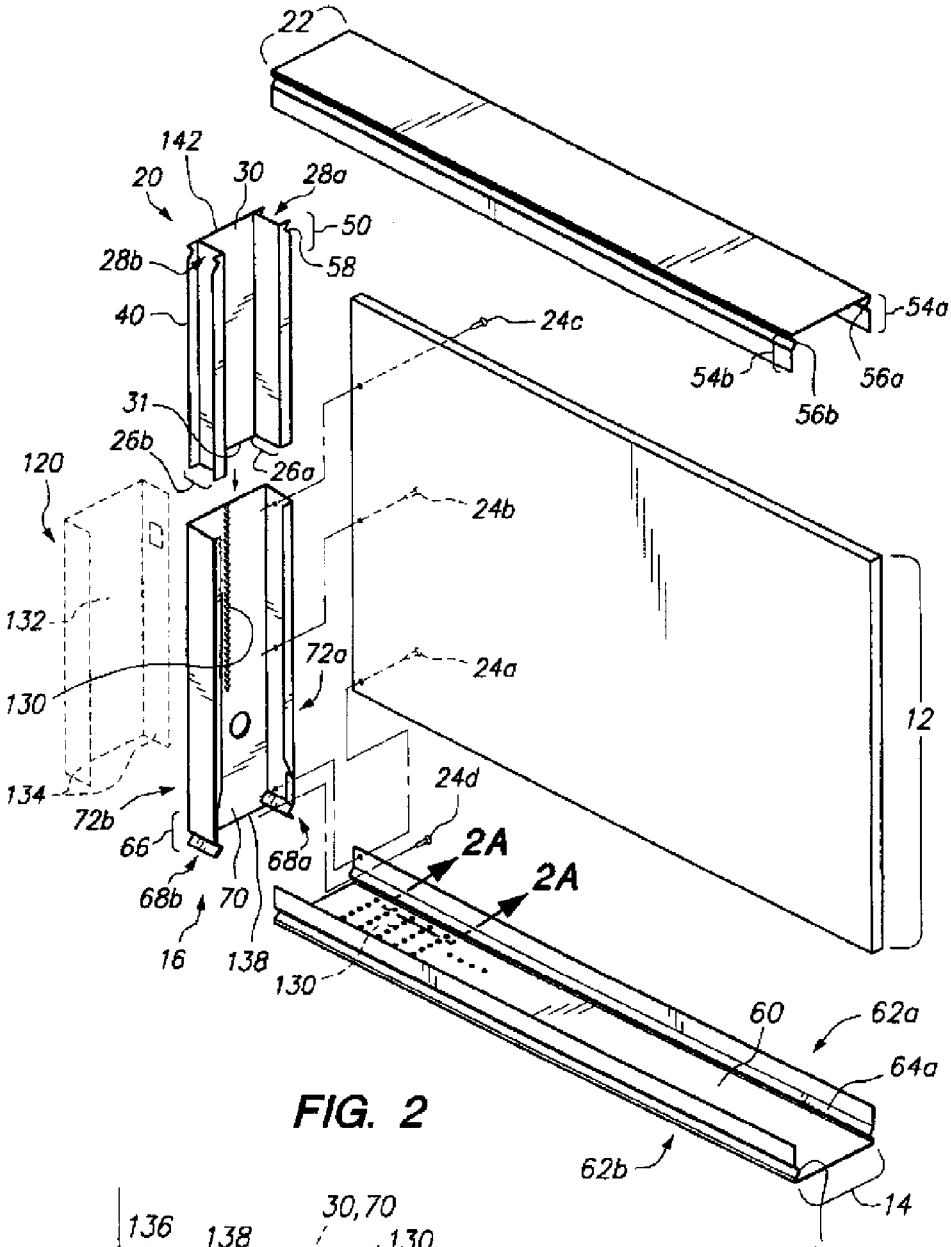
FIG. 2 is an exploded view of the wall structure shown in FIG. 1.
Figure 2A:
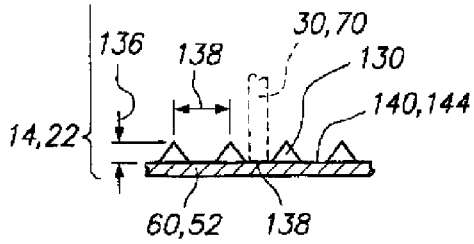
FIG. 2A is a cross sectional view of a web of a bottom or top track having protrusions.

As shown in FIG. 2, in order to fasten the drywall 12 to the stationary portion 16 but not the telescoping portion 20, the exterior of one or both sidewalls 26*a, b* of the telescoping portion 20 may be formed with recesses 28*a, b*. The recesses 28*a, b* are formed along the entire length or substantially the entire length of the sidewalls 26*a, b* of the telescoping portion 20. The fasteners 24*a, b*, and *c* are fastened to the stationary portion 16 of the vertical stud 18 but not to the telescoping portion 20. The recess 28*a* of the telescoping portions 20 allows the installer to fasten the fastener 24*c* at any vertical position, of the stationary portion 16 without inadvertently securing the fastener 24*c* (see FIG. 2) to the telescoping portion 20 because the recess 28*a* extends along the entire length or a substantial length of telescoping portion 20 and a length 32 (see FIG. 3) of the screw 24*c* (see FIG. 3) is not long enough to thread into sidewall 26*a, b* (see FIG. 2) of the telescoping portion 20. Accordingly, this construction provides for faster install or erection of the wall structure and mitigates installation error. Each of the sidewalls 26*a*, 26*b* of the telescoping portion 20 has a width that is almost as wide as the width of the sidewalls of the stationary portion 16 while allowing the telescoping portion 20 to telescope within the stationary portion 20. The recesses 28*a*, 28*b* have a width that is almost as wide as the width of the respective sidewall 26*a*, 26*b* of the telescoping portion 20.

Figure 3:
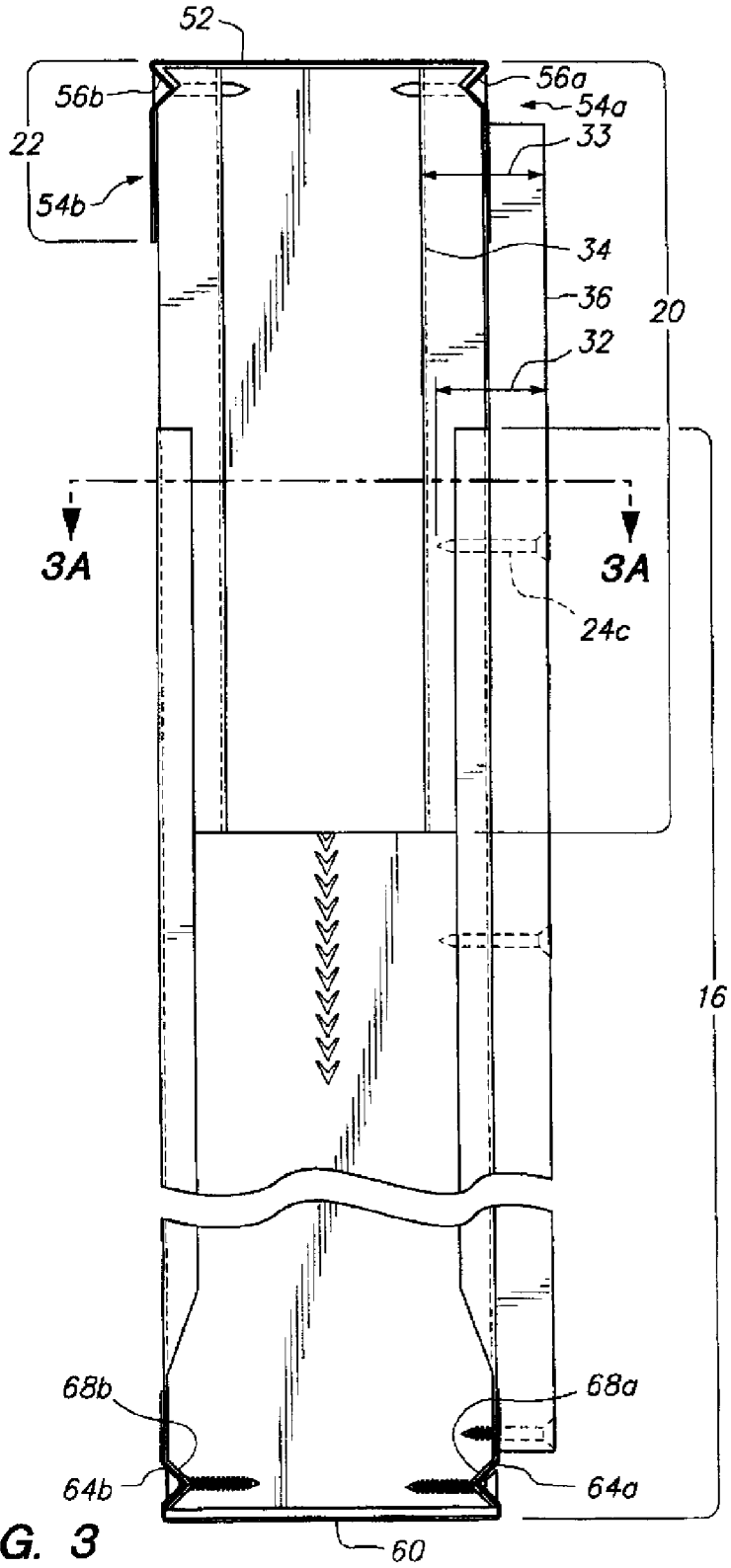
FIG. 3 is a cross sectional view of the wall structure shown in FIG. 1.
Figure 3A:
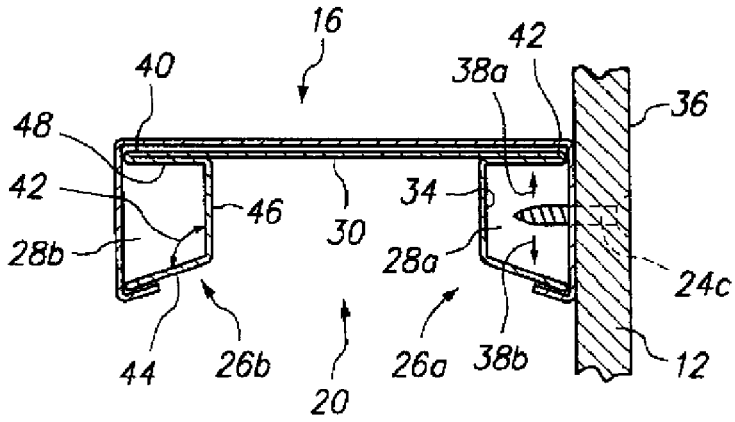
FIG. 3A is a cross sectional view of the wall structure shown in FIG. 3.

Also, the web 70 of the stationary portion 16 may be formed with projections 130 (see FIG. 2) that provide additional frictional engagement of the web 30 of the telescoping portion 20 and/or a lower edge 31 (see FIG. 2) of the web 30 of the telescoping portion 20 for preventing the telescoping portion 20 from inadvertently sliding into the stationary portion 16 during installation. As shown in FIGS. 3 and 3A, the telescoping portion 20 is inserted within the stationary portion 16. The telescoping portion 20 may have a friction fit within the stationary portion 16.

As can be seen in FIG. 3, the length 32 of the fastener 24*c* is shorter than a distance 33 between an inner surface 34 of the sidewalls 26*a, b* of the telescoping portion 20 and an exterior surface 36 of the drywall 12. In this manner, the fastener 24*c* is not long enough to secure itself to the telescoping portion 20. A tip of the fastener resides within the recess 28*a, b*. In the event that the fastener 24*c* is moved laterally as shown by arrows 38*a, b* in FIG. 3A, the fastener 24*c* touches a portion of the sidewall 26*a* and is deflected away and not secured to the sidewall 26*a*. The same is true for sidewall 26*b*.

Figure 3B:
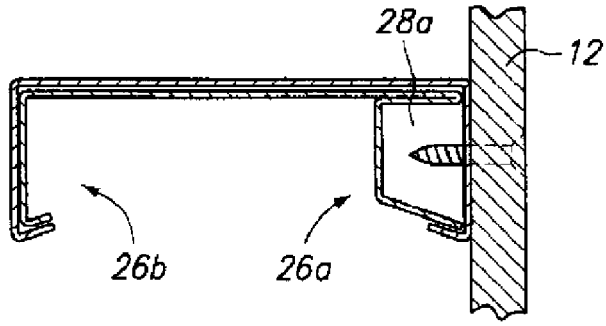
FIG. 3B is an alternate embodiment of the wall structure shown in FIG. 3.
Figure 3C:
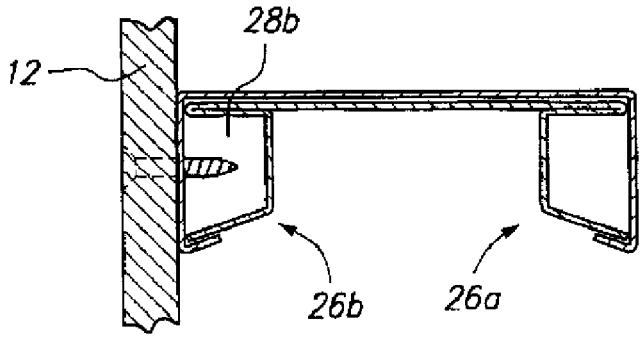
FIG. 3C is a further alternate embodiment of the wall structure shown in FIG. 3.

The web 30 of the telescoping portion 20 defines longitudinal edges 40, 42 shown in FIGS. 2 and 3A. The edges 40, 42 run substantially along the entire length of the telescoping portion 20. To fabricate the recesses 28*a, b*, the sidewalls 26*a, b* are folded with an obtuse angle 42 (see FIG. 3A) between a distal end portion 44 and a floor or bottom portion 46, as shown in FIG. 3A. A right angle is formed between the bottom portion 46 and a setback portion 48. The setback portion 48 is then formed flush against the web 30 of the telescoping portion 20. The sidewall 26*a* has mirror structures compared to sidewall 26*b*. However, it is also contemplated that the recess 28 may be formed in either one of the sidewalls 26*a, b*. By way of example and not limitation, one of the sidewalls 26*a, b* may be formed with the recess 28, as shown in FIG. 3B or vice versa as shown in FIG. 3C.

The upper distal end portion 50 (see FIG. 2) of the telescoping portion 20 may be engaged to the top track 22 (see FIG. 2). In particular, the top track 22 has a web 52 (see FIG. 3) with sidewalls 54*a, b* extending from the web 52, as shown in FIG. 3. As shown in FIGS. 2 and 3, the sidewalls 54*a, b* may have inwardly directed protrusions 56*a, b*. These inwardly directed protrusions 56*a, b* may have a V-shaped configuration. The inwardly directed protrusions 56*a, b* may engage notches 58 (see FIG. 2) formed in the upper distal end portion 50 of the telescoping portion 20. The notches 58 (see FIG. 2) may have corresponding configurations with the inwardly directed protrusions 56*a, b*, as shown in FIG. 3. The notches 58 are formed through the web 30, the setback portion 48 and the distal end portion 44 of the sidewalls 26 of the telescoping portion 20.

The stationary portion 16 may engage the bottom track 14. The bottom track 14 may also have a web 60 (see FIG. 2) with sidewalls 62*a, b* extending from the web 60. The sidewalls 62*a, b* have inwardly directed protrusions 64*a, b* (see FIGS. 2 and 3) which extend along a substantial length or entire length of the bottom track 14. These inwardly directed protrusions 64*a, b* may have a V-shaped configuration. The bottom distal end portion 66 (see FIG. 2) of the stationary portion 16 may have inwardly directed recesses 68*a, b* (see FIGS. 2 and 3) which correspond and engage the inwardly directed protrusions 64*a, b*.

The stationary portion 16 may have a web 70 (see FIG. 2). Sidewalls 72*a, b* may extend from the web 70. The bottom distal end portion 66 (see FIG. 2) of the sidewalls 72*a, b* and the web 70 of the stationary portion 16 may form the inwardly directed recesses 68*a, b*.

The stationary portion 16 may be engaged to the bottom track 14 by inserting the bottom distal end portion 66 between the sidewalls 62*a, b* of the bottom track 14 then rotating the stationary portion 16 until the inwardly directed protrusions 64*a, b* of the bottom track 14 reside within the inwardly directed recesses 68*a, b* of the bottom distal end portion 66 of the stationary portion 16. To fix the location of the stationary portion 16 on the bottom track 14, the sidewalls 62*a, b* of the bottom track 14 may be fastened to the sidewalls 72*a, b* of the stationary portion 16. The telescoping portion 20 is fixed the top track 22 by fastening the sidewalls 54*a, b* of the top track 22 to the floor or bottom portion 46. Similar to the stationary portion 16, the telescoping portion 20 may be engaged to the top track 22 by initially inserting the upper distal end portion 50 (see FIG. 2) of the telescoping portion 20 between the sidewalls 54*a, b* of the top track 22 then rotating the telescoping portion 20 until the inwardly directed protrusions 56*a, b* engages the notches 58 of the telescoping portion 20.

The stationary portion 16 and the telescoping portion 20 which comprises the vertical stud 18 may be placed at regular intervals within the fire rated wall structure, typically, 16" apart.

Figure 4:
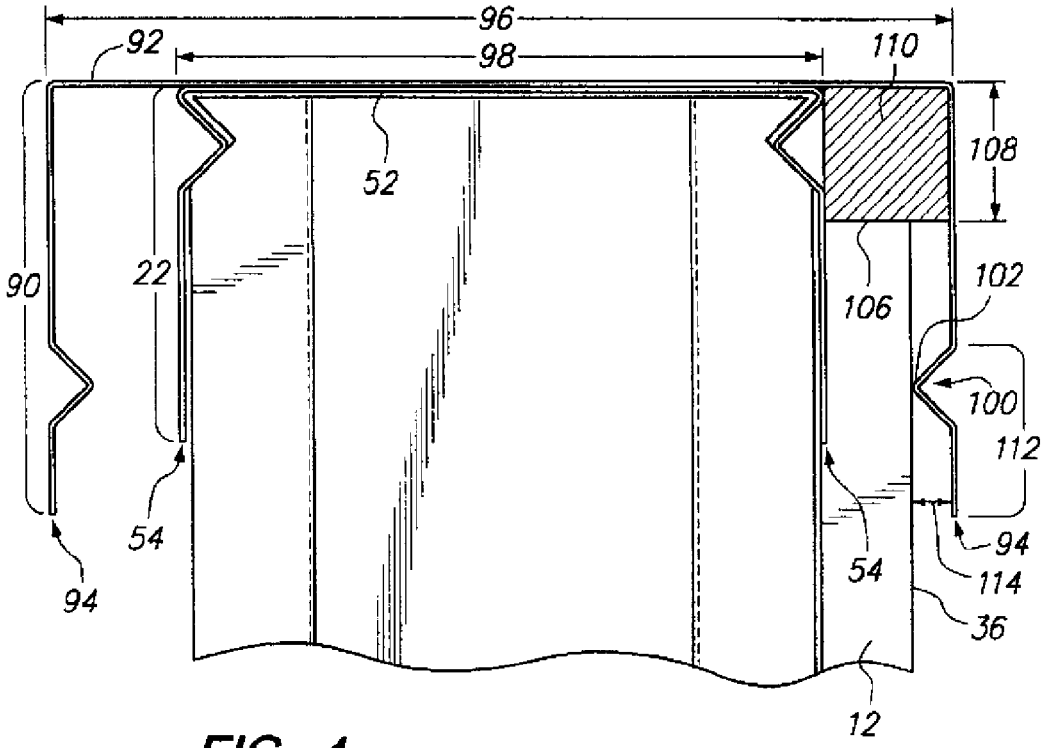
FIG. 4 is an enlarged cross sectional view of a vertical stud, top track and a top overcap illustrating a first embodiment of the top overcap.

Referring back to FIG. 1, an elongate top overcap 90 is shown which may be secured in overlapping relation to the top track 22. The top overcap 90 may have a web 92 and two sidewalls 94 that extend from the web 92. Referring now to FIG. 4, a width 96 of the web 92 may be greater than a width 98 of the web 52 of the top track 22 such that the top track 22 is nested within the top overcap 90. During installation, the top track 22 and the top overcap 90 are secured to the ceiling such as by fasteners and the like. The drywall 12 may be disposed between the sidewall 94 of the top overcap 90 and the sidewall 54 of the top track 22. To mitigate or reduce the amount of smoke and heat entering a space between the sidewall 94 of the top overcap 90 and the sidewall 54 of the top track 22, the sidewalls 94 of the top overcap 90 may be formed with inwardly directed protrusions 100 along a substantial or entire length of the top overcap 90. The inwardly directed protrusions 100 may have a V-shaped configuration in which an apex 102 of the inwardly directed protrusion 100 contacts the exterior surface 36 of the drywall 12. Preferably, the apex 102 is in slidable contact with the exterior surface 36 of the drywall 12 such that during vertical displacement of the telescoping portion 20 and the stationary portion 16, the apex 102 slides against the exterior surface 36 of the drywall 12 to allow for such vertical movement.

The upper end 106 of the drywall 12 may have a gap 108 from the web 92 of the top overcap 90. This gap 108 allows for the spatial variation between the ceiling and the floor such that the upper end 106 of the drywall 12 does not hit or interfere with the web 92 of the top overcap 90. Fire resistant capabilities of the wall structure 10 may further be enhanced by disposing a fire retardant compound 110 within the gap 108. Although any type of fire resistant compound is contemplated, the compound 110 is preferably a fire resistant and/or fire retardant in order to resist heat and allow for appropriate expansion of the metal frame structure. The compound 110 may be compressable to allow the upper end 106 of the drywall 12 to move closer to the web 92 of the top overcap 90.

As shown in FIG. 4, a distal end portion 112 of the sidewall 94 of the top overcap 90 may have a gap 114 from the exterior surface 36 of the drywall 12. This aids in the insertion of the drywall 12 between the sidewall 94 of the top overcap 90 and the sidewall 54 of the top track 22.

Figure 5:
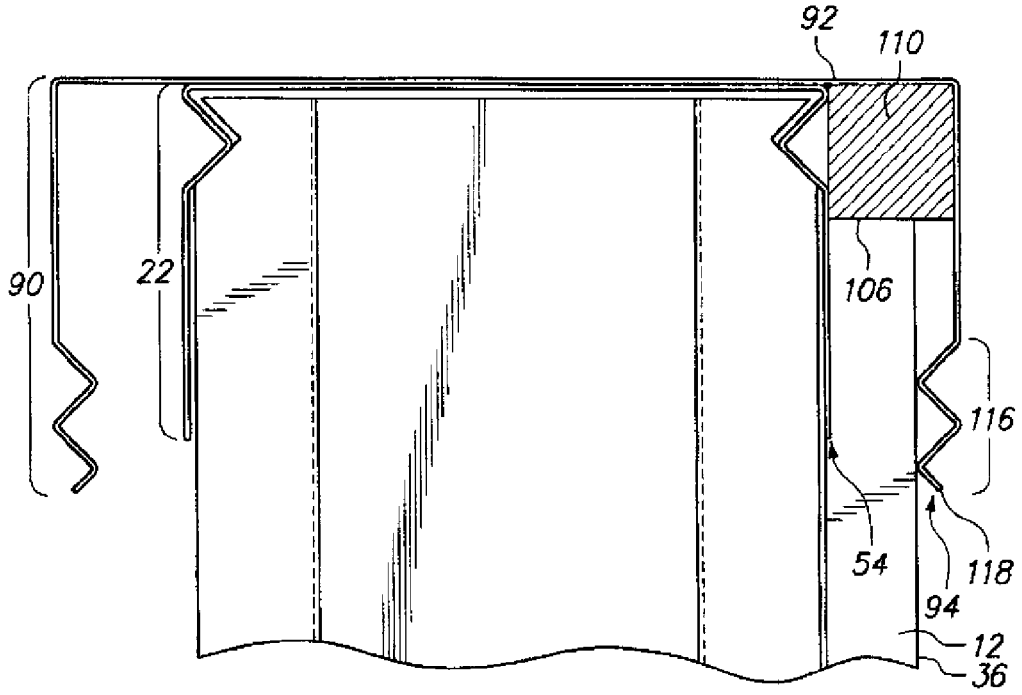
FIG. 5 is an enlarged cross sectional view of a vertical stud, top track and a top overcap illustrating a second embodiment of the top overcap.

Moreover, referring now to FIG. 5, the sidewalls 94 of the top overcap 90 may have stacked inwardly directed protrusions 116 that function similar to the inwardly directed protrusions 100 discussed in relation to FIG. 4. The fire retardant compound 110 may be disposed between the upper end 106 of the drywall 12 and the web 92 of the top overcap 90. The distal end 118 of the sidewall 94 of the top overcap 90 may be gaped away from the exterior surface 36 of the drywall 12 to assist in insertion of the drywall 12 between the sidewall 94 of the top overcap 90 and the sidewall 54 of the top track 22.

The inter connection between the telescoping portion 20 and the top track 22 and the stationary portion 16 and the bottom track 14 may be accomplished as shown in U.S. patent application Ser. Nos. 09/979,214 and 11/146,534, the entire contents of which are incorporated herein by reference.

Referring now to FIG. 1, a stud overcap 120 may be mounted to the stationary portion 16 of the vertical stud 18. The stud overcap 120 may be preferably disposed in non-connective overlapping relation to the telescoping portion 20 and is only connected to the stationary portion 16 such that the stud overcap 120 does not impede vertical displacement of the telescoping portion 20. More particularly, prior to installation of the drywall 12 to the wall frame (i.e., stationary portions 16 of the vertical stud 18), the stud overcap 120 may be placed over the stud and under the drywall, as shown in FIG. 1. The stud overcap 120 may be attached to the stationary portion 16 with screw or fastener 24. Optionally, the stud overcap 120 may have an aperture 124 disposed at the overlapping portion 126 (see FIG. 1). The aperture 124 permits the construction worker to fasten the drywall 12 solely to the stationary portion 16 at the overlapping portion 126. As shown in FIG. 2, the stud overcap 120 may have a web 132 and sidewalls 134 extending generally perpendicular from the web 132. A width of the web 132 may correspond to a width of the web 70 of the stationary portion 16 such that the sidewalls 134 of the stud overcap 120 is flush against the sidewalls 86 of the stationary portion 16.

Referring now to FIG. 2, projections 130 may optionally be provided on the web 70 of the stationary portion 16. These projections 130 may be in the form of knurls or bumps formed on an internal surface of the web 70. The projections 130 function to provide frictional sliding resistance between the telescoping portion 20 and the stationary portion 16. Additionally, it is contemplated that projections 130 may also be formed on an interior surface of the web 60 of the bottom track 14 or web 52 of the top track 22. These projections 130 frictionally engage the upper end of the vertical stud 18 or the lower end of the vertical stud 18 to prevent shifting of the vertical stud 18 during installation yet allow minute adjustments, if necessary. The projections 130 may have a pin shaped configuration or a knurl shaped configuration. The projections 130 may extend from an interior surface of the web 70 of the stationary portion 16, web 60 of the bottom track 14 or web 52 of the top track 22. The projections 130 may define a height 136 as well as a lateral spacing 138. The lateral spacing 138 is greater than or equal to a thickness of a web 30 of the telescoping portion 20 or a thickness of a web 70 of the stationary portion 16. As shown in FIG. 2, the projections 130 are formed in a series of rows along the length of the bottom track 14 and top track 22. The web 30, 70 fits between adjacent rows of projections 130. The lateral spacing 138 between adjacent projections 130 or rows of projections 130 is such that the web 30, 70 does not excessively wiggle between the rows of projections 130. The height 136 of the projections 130 is sized such that the web 30, 70 does not jump over a projections 130 during normal handling.

Also, it is contemplated that the web 30, 70 may be moved by applying a left or right force (e.g., hammer) to the web 30, 70. The web 30, 70 may be jumped over adjacent projections 130 also by strong arming the web 30, 70. The height 136 of the projections 130 are also small enough such that the stationary portion 16 and the telescoping portion 20 can be twisted into engagement with the top and bottom tracks 22, 14. As discussed herein, the top and bottom tracks have inwardly directed protrusions 64*a, b* and 56*a, b*. These inwardly protrusions engage inwardly directed recesses 68*a, b* and notches 58. The interengagement of the inwardly directed protrusions 64*a, b* and 56*a, b* with the inwardly directed recesses 68*a, b* and 58 provide a snug fit between the stationary portion 16 and the bottom track 14 and the telescoping portion 20 with the top track 22. The interengagement may push the bottom edge 138 toward or against the upper surface 140 of the web 60 of the bottom track 14. Also, the interengagement between the inwardly directed protrusions 56*a, b* within the notches 58 of the telescoping portion 20 may push the upper edge 142 of the web 30 of the telescoping portion 20 toward or against the bottom surface of the web 52 of the top track 22. The height 136 of the protrusions 130 are sized to allow the twisting action of the vertical stud for engagement with the top track 22 and bottom track 14 but yet prevent lateral movement once engaged.

The wall structure 10 may be assembled in the following manner. In particular, the location of the top track 22 and the bottom track 14 are located on the ceiling and floor, respectively. The top track 22 may be nested within the top overcap 90 as shown in FIGS. 4 and 5. With the top track 22 nested within the top overcap 90, the top track 22 and the top overcap 90 are secured to the ceiling. By way of example and not limitation, a plurality of screws may be screwed through the web 52 of the top track 22 and the web 92 of the top overcap 90 and into the ceiling along a longitudinal length of the top track 22. Preferably, the top overcap 90 is coextensive with the top track 22. Also, the sidewalls 54*a, b* of the top track 22 are preferably placed in the middle of the sidewalls 94 of the top overcap 90, as shown in FIGS. 4 and 5. However, it is contemplated that the top track 22 may be disposed toward or against one or the other side of the top overcap 90 as desired.

Next, the bottom track 14 is secured to the floor. By way of example and not limitation, screws may be screwed into the web 60 of the bottom track 14 and into the floor along a longitudinal length of the bottom track 14. The bottom track 14 is preferably disposed directly under the top track 22 so as to form a vertical wall frame.

The telescoping portion 20 may now be inserted into the stationary portion 16. The projections 130 on the web 70 of the stationary portion 16 is placed in frictional contact with the web 30 of the telescoping portion 20 and/or a lower edge 31 of the web 30 of the telescoping portion 20. The projections 130 and the friction fit between the telescoping portion 20 and the stationary portion 16 prevent free sliding movement of the telescoping portion 20 within the stationary portion 16.

The length of the vertical stud 18 (telescoping portion 20 and the stationary portion 16) is adjusted to match the particular ceiling to floor distance or a distance between the top track 22 and the bottom track 14. More particularly, the ceiling to floor distance may not be constant along the length of a top track 22 and the bottom track 14. Rather, due to variances in building material and construction, there may be slight or major differences in the distance between the ceiling/top track 22 and the floor/bottom track 14. The vertical stud 18 is placed at the general location of its final precise location. The vertical stud 18 is placed between the top track 22 and the bottom track 14 in a rotated relationship with the top track 22 and the bottom track 14. The bottom end of the stationary portion 16 contacts the web 60 of the bottom track 14. The telescoping portion 20 is now extended such that the upper end of the telescoping portion 20 contacts the web 52 of the top track 22. At this point, the notch 58 in the telescoping portion 20 is generally aligned to the inwardly directed V-shaped protrusions 56*a, b* of the top track 22. Also, the inwardly directed recesses 68*a, b* of the stationary portion is generally aligned to the inwardly directed protrusions 64*a, b* of the bottom track 14. The projections 130 of the stationary portion 16 prevent the telescoping portion 20 from sliding into the stationary portion 16 once the length of the vertical stud 18 is set. The vertical stud 18 is disposed at the general location of its final position. The stationary portion 16 and the telescoping portion 20 are then rotated to interlock the inwardly directed protrusions 64*a, b* of the bottom track 14 into the inwardly directed recesses 68*a, b* of the stationary portion 16 as well as the inwardly directed protrusions 56*a, b* of the top track 22 and the notches 58 of the telescoping portion 20.

With the vertical stud located at the general location of its final location, the installer may now tap the upper distal end portion 50 of the telescoping portion 20 and the bottom distal end portion 66 of the stationary portion 16 in either the left or right direction in minute amounts to accurately locate the vertical stud 18 along the top track 22 and the bottom track 14 to its final location. The projections 130 formed on the web 60 of the bottom track 14 engages the bottom end of the stationary portion 16 and the projections 130 formed on the web 52 of the top track 22 frictionally engage the upper end of the telescoping portion 20 to prevent minor shifting of the vertical stud 18 during assembly. When the installer taps the upper distal end 50 of the telescoping portion 20, the upper edge 142 of the web 30 of the telescoping portion 20 jumps adjacent projections 130. Likewise, when the installer taps the bottom distal end portion 66 of the stationary portion 16, the bottom edge 138 jumps across adjacent projections 130.

With the stud at the desired pinpoint location, the fastener (e.g., screw) may be screwed into the sidewall 62*a, b* of the bottom track 14 and the sidewall 72*a, b* of the stationary portion 16. In particular, the fastener (see FIG. 3) may be inserted into the nested inwardly directed protrusions 64*a, b* and the inwardly directed recesses 68*a, b*. Additionally, it is contemplated that a fastener (e.g., screw) may be screwed into the inwardly directed protrusions 56*a, b* of the top track and be secured to the bottom portion 46 of the sidewalls 26 of the telescoping portion 20. The vertical stud 18 is now fixed and cannot move laterally with respect to the top track 22 and the bottom track 14. Additional vertical studs are attached to the top track 22 and the bottom track 14 as described above along the length of the top track 22 and the bottom track 14. Preferably, the studs are disposed approximately 16" away from each other, center to center.

With all of the studs 18 attached to the top track 22 and the bottom track 14, the drywall is attached to one or both sides of the wall frame comprising the top track 22, bottom track 14 and the plurality of vertical studs 18. To this end, the drywall is only attached to the stationary portion 16 and not to the telescoping portion 20. By way of example and not limitation, a plurality of screws are threaded into and through the drywall 12 and in the sidewall 86 of the stationary portion 16, as shown in FIG. 2. These screws are not threaded into any portion of the telescoping portion 20. With respect to the overlapping portion 126 of the telescoping portion 20 and the stationary portion 16, the screw is not engaged to the telescoping portion 20. Rather, the telescoping portion 20 has recesses 28*a, b* which allows the screw to thread through the sidewall 86 of the stationary portion 16. However, a length of the screw is not long enough such that the tip of the screw engages the floor 88 of the sidewalls 26 of the telescoping portion 20. Preferably, the tip of the screw does not contact the floor 88 of the sidewalls 26 of the telescoping portion 20. Rather, the tip of the screw resides within the recess. However, it is contemplated that the tip of the screw may contact the sidewalls 26 of the telescoping portion 20 very slightly but yet not prevent vertical displacement of the telescoping portion 20.

To install the drywall adjacent or flush against the plurality of vertical studs 18, the upper end 106 of the drywall 12 may initially be laid against the exterior of the vertical stud 18. The drywall 12 may then be pushed upward between the sidewall 54 of the top track 22 and the sidewall 94 of the top overcap 90. The apex 102 of the inwardly directed protrusions 100 or the stacked inwardly directed protrusions 116 slide against the exterior 36 of the drywall 12 until the drywall 12 is located in position. The screws are now screwed into the drywall 12 and the stationary portion 16. Optionally, a screw may be inserted through the drywall 12 as well as the sidewall 62 of the bottom track 14 and the sidewall 86 of the stationary portion 16, as shown in FIG. 3.

Optionally, a stud overcap 120 may be disposed over the vertical stud 18, as shown in FIGS. 1 and 2. The stud overcap 120 is disposed over the vertical stud 18, and preferably extends an entire length of the vertical stud 18. The stud overcap 120 is also preferably only attached to the stationary portion 16.

As can be seen from a description of the assembly of the wall structure, the same provides for quick installation, fine tune adjustment of the vertical stud along the top and bottom tracks and a wide range of vertical displacement between the ceiling and the floor. The top track 22 and the bottom track 14 do not have unnecessary holes or other stress risers in the sidewalls 54 of the top track 22 and the sidewalls 62 of the bottom track 14. Rather, only when screws are necessary or desired do they pierce the sidewalls of the top track 22 or the bottom track 14. Moreover, the construction worker does not have to worry whether the screws attaching the drywall 12 to the stationary portions 16 were inadvertently also attached to the telescoping portion 20, more particularly, the sidewalls 28*a, b* of the telescoping portions 20.

In the wall structure 10 discussed above, the stationary portion 16 of the vertical stud 18 is attached to the bottom track 14. Also, the telescoping portion 20 of the vertical stud 18 is attached to the top track 22. However, it is also contemplated that the stationary portion 16 may be attached to the top track 22. Also, the telescoping portion 29 may be attached to the bottom track. The drywall 12 could still be attached to the stationary portion 16 and optionally the top track 22. Furthermore, in a further alternative, although the dry wall 12 is attached to the stationary portion 16, it is also contemplated that the dry wall 12 may be attached to the telescoping portion 20 and not to the stationary portion 16.

The wall structure 10 discussed herein may be fire rated. During a fire, the ceiling to floor height may change due to thermal expansion of the parts under heat. Fortunately, the telescoping portion 20 is secured to the ceiling via the top track 22. Also, the stationary portion 16 is secured to the floor via the bottom track 14. The stationary portion 16 is not fastened to the telescoping portion 20. Upon ceiling to floor variations or changes during fire, the telescoping portion 20 moves in and out of the stationary portion 16 to accommodate the thermal expansion and ceiling to floor height variations. The same is true for the wall structure due to ceiling to floor variations caused by normal ambient temperature changes. During sudden large changes of the ceiling to floor height such as during an earthquake or seismic shift, the telescoping portion 20 can easily be inserted into or extracted out of the stationary portion 16 to allow for the sudden large ceiling to floor height variations. The same is also true during slow ceiling to floor variations such as during settling of the building immediately after construction of the building as well as long term settling through the course of a few decades.

Although the various aspects of the wall structure 10 have been discussed in relation to a vertical stud 18 having inwardly directed protrusions that engage into inwardly directed recesses, it is also contemplated that the bottom distal end portion 66 of the stationary portion 16 may be flat so as to engage a normal C-channel. The stationary portion 16 may be fastened to the C-channel with a screw or other fastener. Likewise, the upper distal end portion 50 of the telescoping portion 20 may not have the notches 58. Additionally, the top track 22 may be a common C-channel. The telescoping portion 20 may be fastened or secured to the top track 22 with a screw or other fastener. Nonetheless, all of the benefits discussed herein regarding the wall structure during fire, normal ambient temperature changes, seismic shifts and settling may be applicable to this configuration.

The above description is given by way of example, and not limitation. Given the above disclosure, one skilled in the art could devise variations that are within the scope and spirit of the invention disclosed herein, including various ways of forming the recesses in the sidewalls of the telescoping portion of the vertical stud. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A wall structure comprising:

a bottom horizontal track and a top horizontal track disposed generally parallel to each other, each one of the lower and upper horizontal tracks comprising:

a web defining opposed longitudinal edges; and a pair of side walls extending generally perpendicularly from the opposed longitudinal edges of the web, the pair of side walls being generally parallel to each other;

a vertical stud member comprising:

a stationary portion defining a lower distal end portion and an upper distal end portion, the lower distal end portion attached to the bottom horizontal track, the stationary portion having a web and a pair of sidewalls, with the sidewalls having a width; and a telescoping portion defining a lower distal end portion and an upper distal end portion, the upper distal end portion attached to the top horizontal track, the lower distal end portion of the telescoping portion circumscribed by the upper distal end portion of the stationary portion and in telescopic engagement with the upper distal end portion of the stationary portion, the telescoping portion having a web and a pair of sidewalls, with each of the sidewalls of the telescoping portion having a width that is almost as wide as the width of the sidewalls of the stationary portion while allowing the telescoping portion to telescope within the stationary portion, the exterior of at least one of the pair of sidewalls having a recess extending along a longitudinal length of the telescoping portion, with the recess having a width that is almost as wide as the width of the at least one sidewall of the telescoping portion;

drywall disposed adjacent a side of the vertical stud member; and a fastener having a length less than a sum of a thickness of the drywall, a thickness of the sidewall of the stationary portion and a depth of the recess formed in the exterior of the at least one sidewall of the telescoping portion, the fastener engaged to the drywall and the sidewall of the stationary portion and not attached to the sidewall of the telescoping portion;

wherein the recess is so disposed in relation to the stationary portion as to allow the fastener to be fastened at any vertical position of the stationary portion with a tip of the fastener disposed in the recess without inadvertently securing the fastener to the telescoping portion, and as to allow the telescoping portion to telescope within the stationary portion over the longitudinal extent of the recess during variations in height from ceiling to floor when the fastener is fastened at any vertical position of the stationary portion with the tip of the fastener disposed in the recess.

2. The structure of claim 1 wherein the recess extends along a substantial length or an entire length of the telescopic portion.

3. The structure of claim 1 wherein the telescopic portion is sheet metal comprising: a web having opposed longitudinal edges; sidewalls extending from the longitudinal edges, each sidewall having: a setback portion flush with the web; a bottom portion generally perpendicular with the setback portion; and a distal end portion defining an obtuse angle with the bottom portion.

4. The structure of claim 3 wherein: each of the lower and upper horizontal tracks further comprises: an inwardly directed protrusion formed in the pair of sidewalls and along a longitudinal length of the pair of sidewalls; the vertical stud member further comprises: inwardly directed recess formed in the lower distal end portion of the stationary portion with the inwardly directed protrusion of the bottom horizontal track received therein; notches formed in the upper distal end portion of the telescoping portion with the inwardly directed protrusion of the top horizontal track received therein.

5. The structure of claim 4 wherein the notch of the telescoping portion is formed through the web, the setback portion, the bottom portion and the distal end portion.

6. The structure of claim 4 wherein the web of the top horizontal track have rows of projections formed generally perpendicularly with respect to the longitudinal edges of the top horizontal track and the web of telescoping portion is disposed between adjacent rows of projections formed on the web of the top horizontal track.

7. The structure of claim 4 wherein the web of the bottom, horizontal track have rows of projections formed generally perpendicularly with respect to the longitudinal edges of the bottom horizontal track and the web of the stationary portion is disposed between adjacent rows of projections formed on the web of the bottom horizontal track.

8. The structure of claim 1 wherein the telescoping portion has a friction fit with the stationary portion.

9. The structure of claim 1 wherein the drywall is fastened to the stationary portion and the bottom track.

10. The structure of claim 1 wherein the telescoping portion is frictionally slideable into the stationary portion.

11. The structure of claim 1 wherein the fastener is a screw.

12. The structure of claim 1 wherein the top track is attached to a ceiling and the bottom track is attached to a floor.

13. The structure of claim 1 wherein the stationary portion has a C shaped configuration.

14. The structure of claim 1 wherein the recess of the telescoping portion is disposed immediately adjacent to the sidewall of the stationary portion.

15. A method of erecting a wall structure, the method comprising the steps of:

attaching a top track to a ceiling;

attaching a bottom track to a floor, the bottom track being located directly underneath the top track;

inserting a telescoping portion of a vertical stud into a stationary portion of the vertical stud so as to define an overlapping portion, with the stationary portion having a web and a pair of sidewalls, with the sidewalls having a width, the telescoping portion having a web and a pair of sidewalls, with each of the sidewalls of the telescoping portion having a width that is almost as wide as the width of the sidewalls of the stationary portion while allowing the telescoping portion to telescope within the stationary portion, the exterior of at least one of the pair of sidewalls having a recess extending along a longitudinal length of the telescoping portion, with the recess having a width that is almost as wide as the width of the at least one sidewall of the telescoping portion;

disposing a lower distal end portion of the stationary portion onto the bottom track;

extending the telescoping portion to abut the upper distal end portion of the telescoping portion against the top track;

engaging the telescoping portion to the top track and the stationary portion to the bottom track;

abutting drywall against the vertical studs;

at the overlapping portion, fastening the drywall solely to the stationary portion with a fastener having a length less than a sum of the thickness of the drywall, the thickness of the sidewall of the stationary portion and the depth of the recess formed in the exterior of the at least one sidewall of the telescoping portion;

wherein a tip of the fastener is disposed within a recess of the sidewall of the telescoping portion such that the telescoping portion can telescope within the stationary portion during variations in height from ceiling to floor, and wherein the recess is so disposed in relation to the stationary portion as to allow the fastener to be fastened at an vertical position of the stationary portion without inadvertently securing the fastener to the telescoping portion, and as to allow the telescoping portion to telescope within the stationary portion over the longitudinal extent of the recess during variations in height from ceiling to floor when the fastener is fastened at any vertical position of the stationary portion.

16. The method of claim 15 wherein the fastening step includes the step of screwing a screw into the drywall until a top surface of a head of the screw is flush with an exterior surface of the drywall when the tip of the fastener is disposed within the recess of the sidewall of the telescoping portion.

17. The method of claim 15 wherein the engaging step comprises the step of rotating the telescoping portion and the stationary portion.

18. A telescoping vertical stud member for a wall structure having first and second horizontal tracks and drywall secured to the vertical stud member, the vertical stud member comprising:

a telescoping portion attachable to the first horizontal track, the telescoping portion having a web defining opposed longitudinal edges and opposed sidewalls extending from the opposed longitudinal edges, the exterior of at least one of the opposed sidewalls having a recess running along an entire length or a substantial length of the sidewall; and a stationary portion attachable to the second horizontal track, the stationary portion having a web defining opposed longitudinal edges and opposed sidewalls extending from the opposed longitudinal edges, with the sidewalls of the stationary portion having a width, the web and opposed sidewalls of the stationary portion; circumscribing a portion of the telescoping portion;

wherein each of the sidewalls of the telescoping portion has a width that is almost as wide as the width of the sidewalls of the stationary portion while allowing the telescoping portion to telescope within the stationary portion;

wherein the recess has a width that is almost as wide as the width of the at least one sidewall of the telescoping portion; and wherein when a fastener having a length less than a sum of the thickness of the drywall, the thickness of the sidewall of the stationary portion and the depth of the recess formed in the exterior of the at least one sidewall of the telescoping portion, is fastened to the drywall and the stationary portion, a tip of the fastener is disposed within the recess of the sidewall of the telescoping portion such that the telescoping portion telescopes in and out of the stationary portion during variations in height from ceiling to floor; and wherein the recess is so disposed in relation to the stationary portion as to allow the fastener to be fastened at an vertical position of the stationary portion with a tip of the fastener disposed in the recess without inadvertently securing the fastener to the telescoping portion, and as to allow the telescoping portion to telescope within the stationary portion over the longitudinal extent of the recess during variations in height from ceiling to floor when the fastener is fastened at an vertical position of the stationary portion with the tip of the fastener disposed in the recess.

19. The telescoping vertical stud member of claim 18 wherein the telescoping portion is frictionally engaged to the stationary portion.

20. The telescoping vertical stud member of claim 18 wherein the recess comprises: a bottom portion extending generally perpendicular from a web of the telescoping portion; and distal end portion attached to the bottom portion and forming a obtuse angle with the bottom portion.

* * * * *